US008061804B2

(12) United States Patent
Shimizu et al.

(10) Patent No.: US 8,061,804 B2
(45) Date of Patent: Nov. 22, 2011

(54) PRINTING APPARATUS AND PRINTING APPARATUS CONTROL METHOD

(75) Inventors: Atsushi Shimizu, Sagamihara (JP); Masaaki Matsuura, Kawasaki (JP); Tsuyoshi Otani, Kawasaki (JP); Ken Hoshino, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 406 days.

(21) Appl. No.: 12/333,286

(22) Filed: Dec. 11, 2008

(65) Prior Publication Data

US 2009/0153611 A1 Jun. 18, 2009

(30) Foreign Application Priority Data

Dec. 14, 2007 (JP) ..... 2007-324013

(51) Int. Cl.
*B41J 2/165* (2006.01)

(52) U.S. Cl. ..... 347/32
(58) Field of Classification Search ..... None
See application file for complete search history.

(56) References Cited

FOREIGN PATENT DOCUMENTS

JP 2004-090293 3/2004

*Primary Examiner* — Julian Huffman
*Assistant Examiner* — Tracey McMillion
(74) *Attorney, Agent, or Firm* — Canon USA Inc IP Division

(57) ABSTRACT

A method of moving a cap apart from a printhead within a short period of time without damaging a printing apparatus when the cap sticks to the printhead. A cap moving unit is driven to try to move the cap apart from the printhead. When a detection unit for detecting that the cap has moved apart from the printhead detects that the cap has not moved apart from the printhead, it is controlled to slightly reciprocate the carriage while driving the cap moving unit. When the detection unit detects that the cap has moved apart from the printhead under this control, the slight reciprocation of the carriage is forcibly stopped.

7 Claims, 6 Drawing Sheets

PRINTING APPARATUS AND PRINTING APPARATUS CONTROL METHOD

BACKGROUND OF THE INVENTION

1. Field of the Invention

The present invention relates to a printing apparatus having a cap for protecting the nozzle formation surface of a printhead, and a method of moving the cap apart from the printhead when the cap sticks to the printhead.

2. Description of the Related Art

A printing apparatus such as an inkjet printing apparatus has a capping device which caps a nozzle formed in a printhead to discharge ink, in order to prevent drying and evaporation of ink and nozzle clogging caused by the ink while the printing apparatus is OFF or idle.

For example, the capping device vertically moves the cap to put the cap on the ink discharge surface of the printhead and remove the cap from it. The cap is moved (cap opening/closing operation) using a motor as a driving source. There has conventionally been known a printing apparatus using a dedicated cap motor as the driving source. There has also been known a printing apparatus which does not have a cap motor, moves a carriage supporting a printhead by a carriage motor, and while moving the cap in synchronism with the carriage, vertically moving the cap along a guide shaft or the like to open/close the cap.

For example, when the printing apparatus is turned on or receives an instruction to execute cleaning, and then receives an instruction to open the cap, it tries to open the cap by driving the cap motor or carriage motor. However, if the printing apparatus has remained OFF or idle for a long time, the cap has stuck to the printhead and cannot be opened even by driving the carriage motor or cap motor. If the cap does not open, neither printing processing nor cleaning processing is performed. In addition, a large current flows through the carriage motor or cap motor owing to feedback control of the motor, and may damage the capping device.

To avoid the damage to the capping device, a technique of moving a cap stuck to a printhead apart from the printhead is disclosed (e.g., Japanese Patent Laid-Open No. 2004-090293). A printing apparatus disclosed in Japanese Patent Laid-Open No. 2004-090293 has a capping device which moves down a cap in synchronism with the carriage operation. An encoder arranged in the carriage monitors the driving amount of a carriage motor which operates the carriage in order to open the cap. Upon the lapse of a predetermined time, it is determined whether or not the driving amount has reached a predetermined value. If no driving amount has reached the predetermined value, it is determined that the cap sticks to the printhead. To move the cap apart from the printhead, the carriage is slightly moved for a predetermined time (slight reciprocation). Then, the carriage is moved again to try to open the cap. By repeating this operation, the cap moves apart from the printhead. By slightly moving the carriage, bubbles enter the joint surface between the cap and the printhead mounted on the carriage little by little, moving the cap apart from the printhead.

However, it takes a long time to open the cap when the above-described operation to slightly move the carriage, then move the carriage again, and try to open the cap is repeated.

Instantaneously when the cap moves apart from the printhead by slightly moving the carriage, as described above, the load for driving the carriage drops, and the carriage might bump against the inner wall of the printing apparatus. The carriage moving width is about the width of a printing medium of the maximum size used in the printing apparatus, and walls are formed on the two sides. If an output current to the carriage motor is large in slightly driving the carriage, instantaneously when the cap moves apart from the printhead, the carriage moves at high speed, bumps against the inner wall of the printing apparatus, and may damage the printing apparatus.

SUMMARY OF THE INVENTION

Accordingly, the present invention is conceived as a response to the above-described disadvantages of the conventional art.

For example, a printing apparatus and a control method used in the apparatus according to this invention are capable of moving a cap apart from a printhead within a short period of time without damaging the printing apparatus when the cap sticks to the printhead.

According to one aspect of the present invention, there is provided a printing apparatus having a carriage which scans a printhead for discharging ink from a nozzle, a cap which caps a nozzle formation surface, and cap moving means for driving the cap to move, the apparatus comprising: detection means for detecting that the cap has moved apart from the printhead from a state in which the cap caps the printhead; control means for, when the cap moving means is driven to try to move the cap apart from the printhead and the detection means detects that the cap has not moved apart from the printhead, controlling to move the carriage while driving the cap moving means; and stop means for forcibly stopping moving the carriage when the detection means detects that the cap has moved apart from the printhead under control of the control means.

According to another aspect of the present invention, there is provided a method of controlling a printing apparatus including a carriage which scans a printhead for discharging ink from a nozzle, a cap which caps a nozzle formation surface, and cap moving means for driving the cap to move, the method comprising: when the cap moving means is driven to try to move the cap apart from the printhead, and detection means for detecting that the cap has moved apart from the printhead detects that the cap has not moved apart from the printhead, controlling to move the carriage while driving the cap moving means; and forcibly stopping moving the carriage in a case where the detection means detects that the cap has moved apart from the printhead under in the controlling step.

The invention is particularly advantageous since, when the cap sticks to the printhead, it can be moved apart from the printhead within a short period of time without damaging the printing apparatus.

Further features of the present invention will become apparent from the following description of exemplary embodiments with reference to the attached drawings.

DESCRIPTION OF THE EMBODIMENT

Exemplary embodiments of the present invention will now be described in detail in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Furthermore, unless otherwise stated, the term "nozzle" generally means a set of a discharge orifice, a liquid channel connected to the orifice and an element to generate energy utilized for ink discharge.

Figure 1:
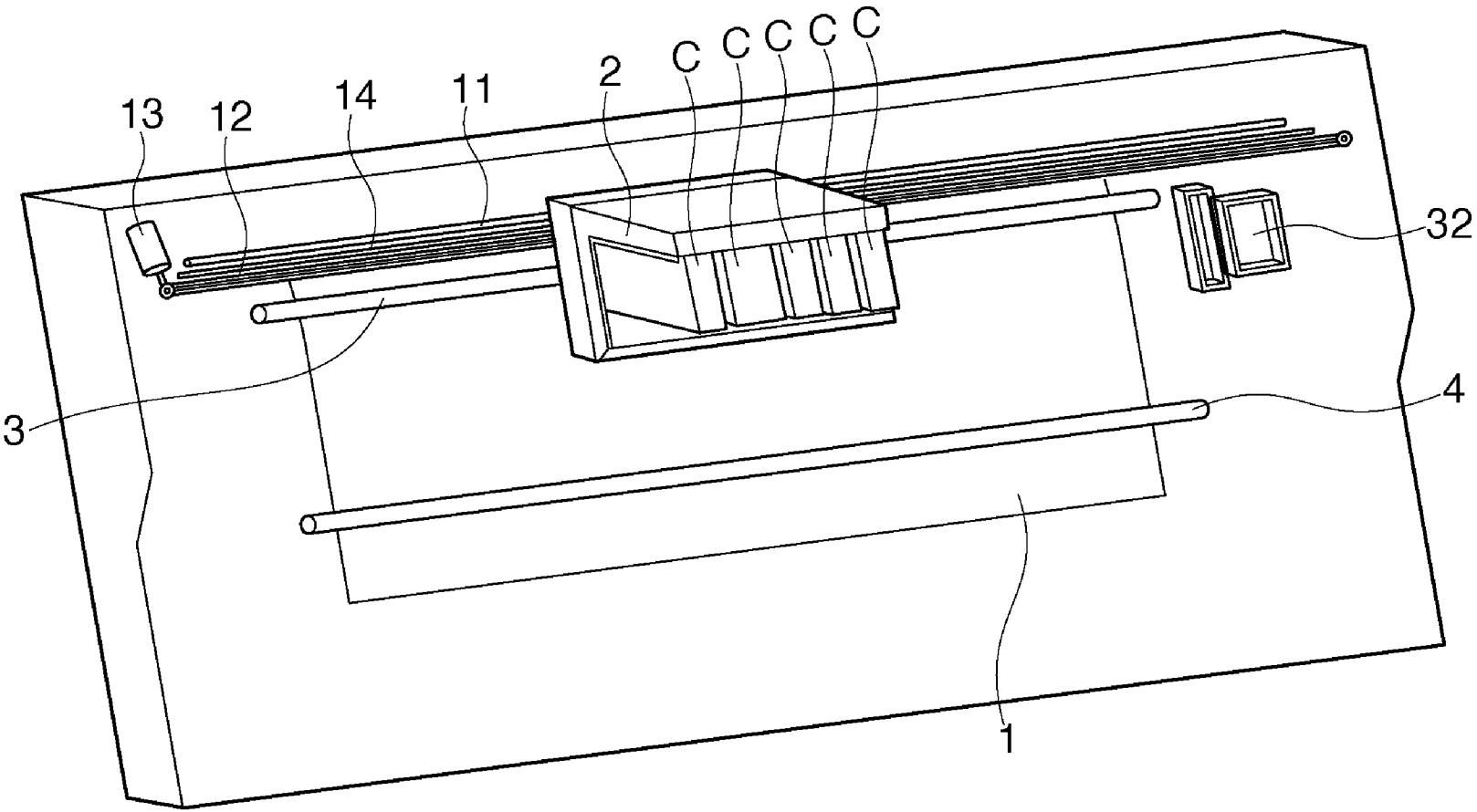
FIG. 1 is a perspective view showing the schematic structure of a printing apparatus having an inkjet printhead to which the present invention is applicable.

FIG. 1 is a perspective view showing the schematic structure of a printing apparatus having an inkjet printhead to which the present invention is applicable.

In FIG. 1, a carriage 2 supports a printhead. A chassis 11 elongates in the moving directions (main scanning direction) of the carriage 2, and supports movement of the carriage 2.

A carriage motor 13 drives the carriage 2. A driving belt 12 transmits the driving force of the carriage motor 13 for reciprocating the carriage 2 in the main scanning direction. An encoder 14 detects the carriage position.

The printhead is mounted on the carriage 2, and ink tanks C which store inks of different colors are mounted on the printhead. Each of the ink tanks C can be removed and exchanged. In this case, independently removable ink tanks are employed. Alternatively, an integrated type ink tank which stores inks of different colors by separating them is also available.

The printhead mounted on the carriage 2 projects down from the carriage 2. The printhead is arranged between a conveyance roller 3 and a discharge roller 4 for conveying a printing medium 1 such as high-quality paper or photo paper. A plurality of nozzles for discharging ink are formed on the lower surface of the printhead, and the nozzle formation surface (nozzle surface) parallelly faces the printing medium 1.

A cap 32 is vertically movable, and comes into tight contact with the nozzle surface of the printhead to cap it. In this manner, the cap 32 prevents evaporation of the volatile component of ink in the nozzle, and prevents the discharge failure of the nozzle caused by ink fixation.

Figure 6:
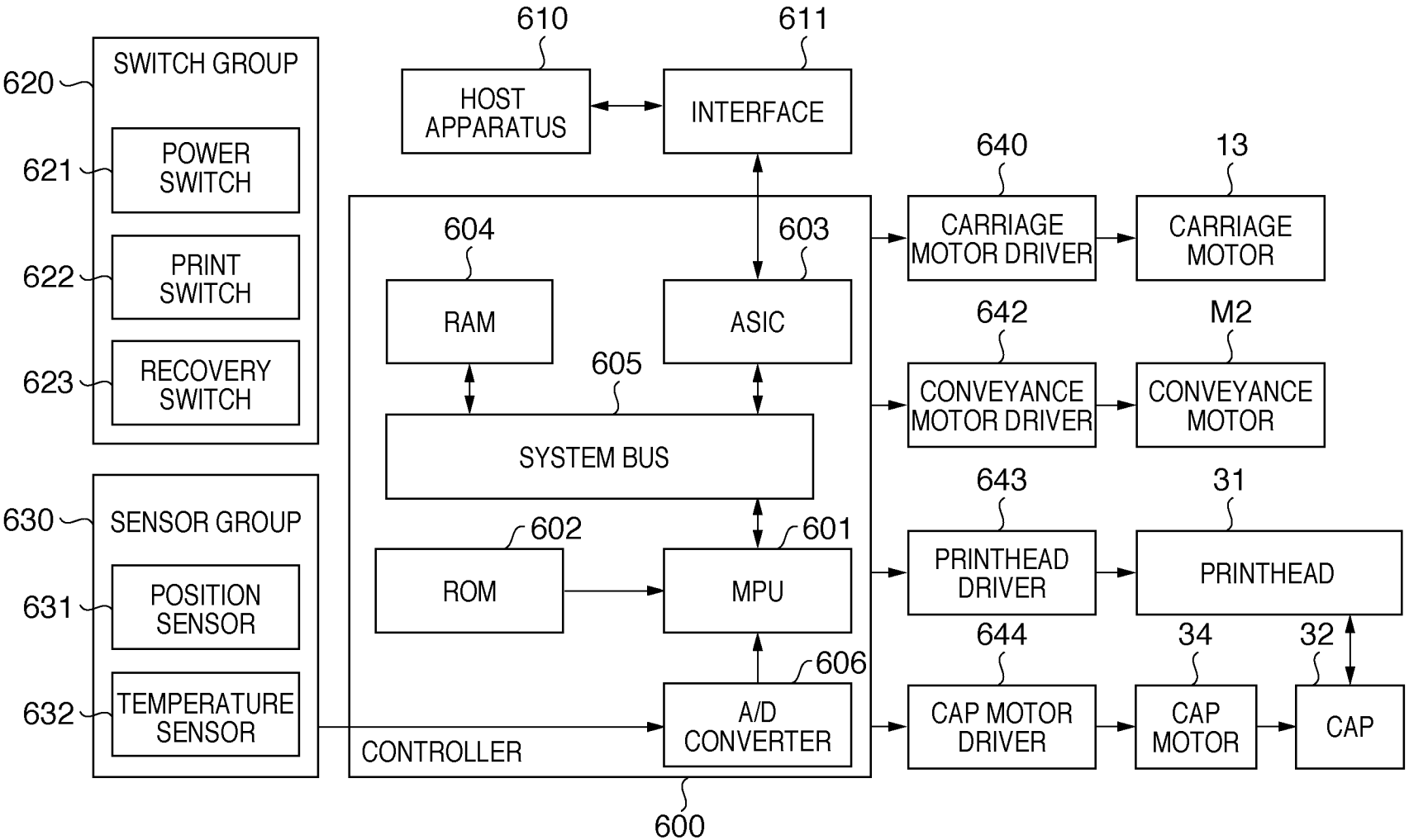
FIG. 6 is a block diagram showing the control arrangement of the printing apparatus shown in FIG. 1.

FIG. 6 is a block diagram showing the control arrangement of the printing apparatus shown in FIG. 1.

As shown in FIG. 6, a controller 600 includes an MPU 601, and a ROM 602 which stores a predetermined table and other permanent data. The controller 600 also includes an ASIC (Application Specific Integrated Circuit) 603 which generates control signals for controlling the carriage motor 13, a conveyance motor M2, and a printhead 31. The controller 600 further includes a RAM 604 having an image data rasterization area, a work area for executing a program, and the like. The controller 600 also includes a system bus 605 which connects the MPU 601, ASIC 603, and RAM 604 to each other and allows exchanging data. The controller 600 includes an A/D converter 606 which A/D-converts analog signals input from sensors (to be described later) into digital signals, and supplies the digital signals to the MPU 601. The controller 600 drives the nozzles at predetermined time intervals in preliminary discharge and printing.

A host apparatus 610 is a computer or the like serving as an image data source. The host apparatus 610 and printing apparatus transmit/receive image data, commands, status signals, and the like via an interface (I/F) 611.

A switch group 620 includes switches for receiving instruction inputs from the operator, such as a power switch 621, a print switch 622 for designating the start of printing, and a recovery switch 623 for designating the start of a recovery operation. A sensor group 630 includes a position sensor 631 such as a photocoupler for detecting a home position, and a temperature sensor 632 arranged at a proper position of the printing apparatus to detect the ambient temperature. The sensor group 630 detects the apparatus state.

A carriage motor driver 640 drives the carriage motor 13. A conveyance motor driver 642 drives the conveyance motor M2. A printhead driver 643 drives the printhead 31.

The cap 32 caps the printhead 31. A cap motor 34 is driven to cap the printhead 31 by the cap 32. A cap motor driver 644 drives the cap motor.

Figure 2:
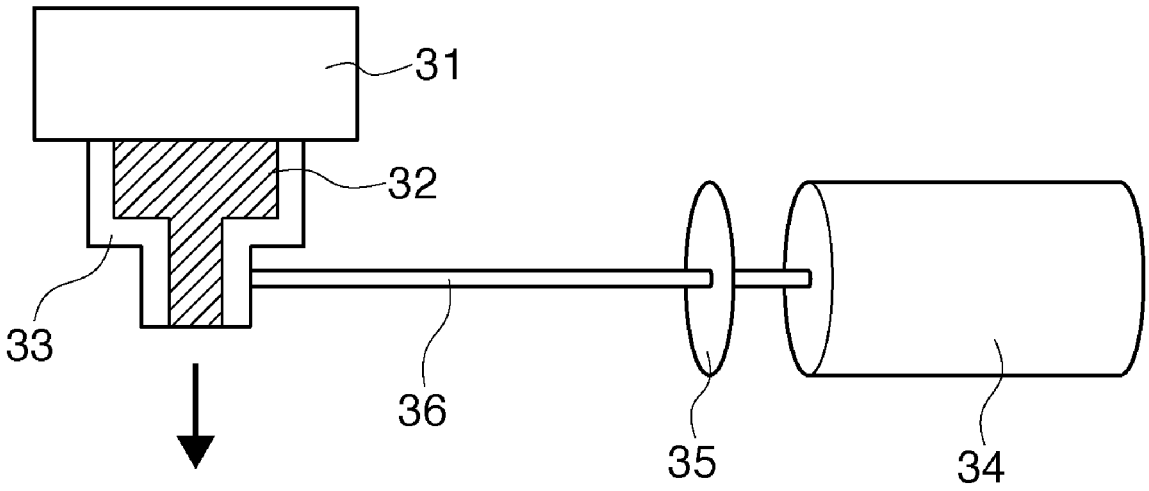
FIG. 2 is a view showing an example of a capping device.

FIG. 2 shows an example of a capping device formed from the cap 32 and the like. The relationship between the printhead and the cap will be explained with reference to FIG. 2.

The capping device includes the cap 32 made of rubber or the like. When the printing apparatus is OFF or idle, the cap 32 caps a surface (nozzle surface) of the printhead 31 on which nozzles are formed. When the printing apparatus is turned on or starts printing and cleaning, the cap 32 is moved apart from the printhead 31. The capping device vertically moves the cap 32 to cap the printhead 31 or moves the cap 32 apart from the printhead 31. More specifically, when capping the printhead 31 (closing the cap), the capping device moves up the cap 32. When moving the cap 32 apart from the printhead 31 (opening the cap), the capping device moves down the cap 32. Note that nozzles are formed on the lower surface of the printhead 31. As shown in FIG. 2, the cap 32 is arranged inside a cap holder 33. In capping, the cap 32 comes into tight contact with the nozzle surface of the printhead. The cap 32 can temporarily store preliminarily discharged ink. The cap 32 communicates with a pump unit (not shown) for sucking preliminarily discharged ink to absorb it in a waste ink sponge absorber (not shown) arranged in the printing apparatus in order to absorb and hold preliminarily discharged ink or the like.

The cap motor 34 moves the cap. The cap motor 34 vertically moves the cap 32 and cap holder 33 to open/close the cap with respect to the printhead 31. A cap encoder 35 is interlocked with the cap motor 34. The cap encoder 35 measures the number of revolutions of the cap motor 34 to detect the moving distances of the cap 32 and cap holder 33 from the number of revolutions. A means 36 transmits the driving force of the cap motor 34.

When the cap motor 34 is driven to move the cap 32 and cap holder 33 in a direction indicated by an arrow shown in FIG. 2, the cap is opened. When the cap 32 and cap holder 33 are moved in a direction opposite to that indicated by the arrow, the printhead 31 is capped (the cap is closed).

When closing the cap from a cap open state, the carriage motor 13 is driven to move the printhead 31 mounted on the carriage 2 to a capping position. After the printhead 31 moves to the capping position immediately above the cap 32, the cap motor 34 is driven to move up the cap 32 and cap holder 33 and bring them into tight contact with the nozzle surface of the printhead 31. As a result, the cap is closed.

Figure 3:
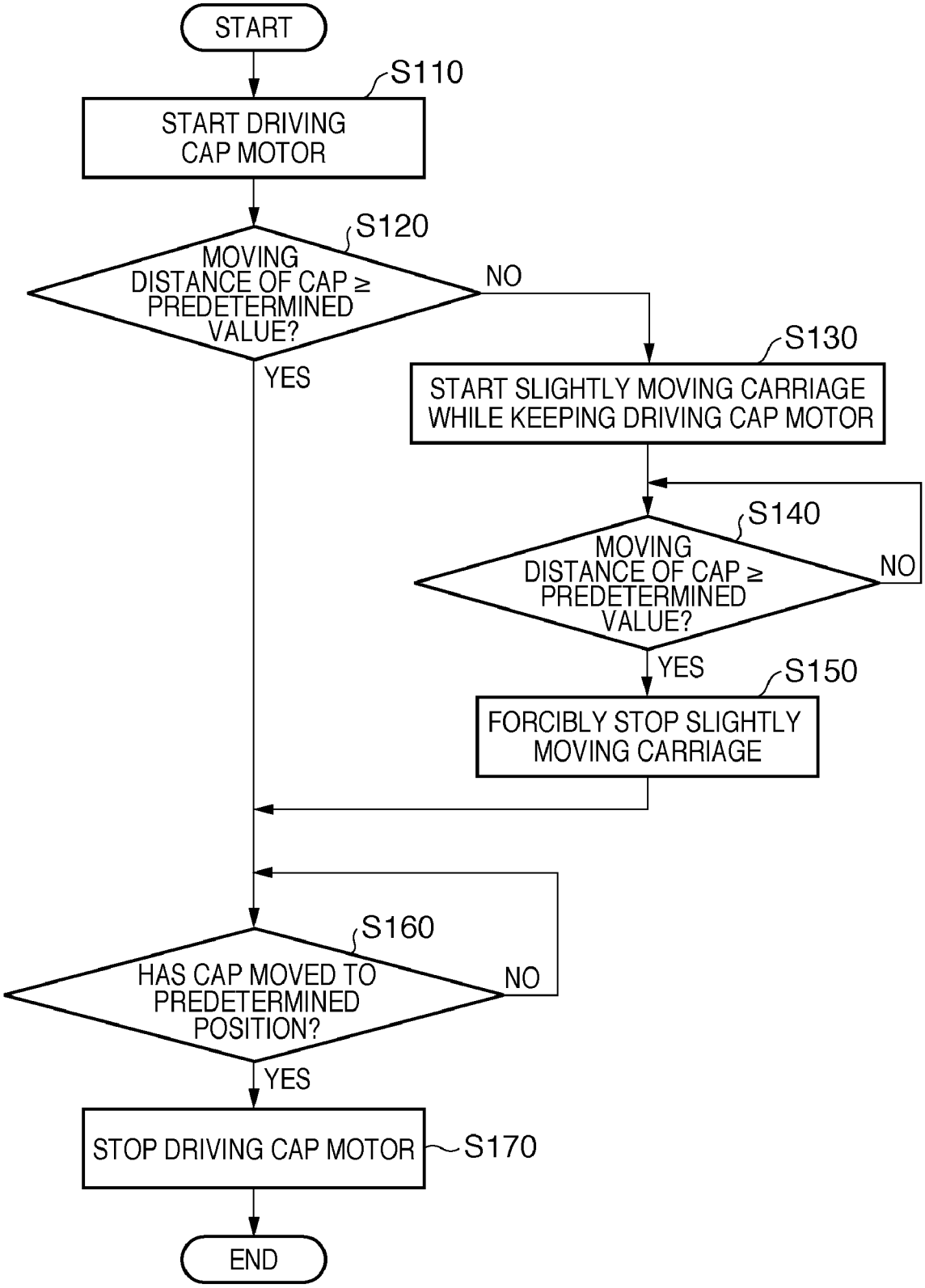
FIG. 3 is a flowchart when opening a cap from a capped printhead.

FIG. 3 is a flowchart when opening the cap from the capped printhead.

Figure 4A:
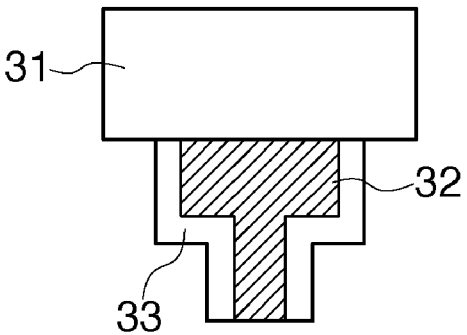
FIGS. 4A, 4B, 4C, 4D, and 4E are schematic views showing the states of the printhead and cap.
Figure 4B:
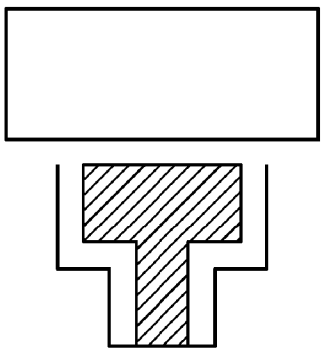

FIG. 3 is a flowchart until the cap is opened as shown in FIG. 4B from a state in which the cap 32 and cap holder 33 are in tight contact with the printhead 31, as shown in FIG. 4A.

In step S110, driving of the cap motor 34 starts to move down the cap, in order to open the cap. While the cap motor 34 is driven, an output from the cap encoder 35 corresponding to the cap motor 34 is monitored in a predetermined period under the control of the MPU 601 or the like.

Figure 4C:
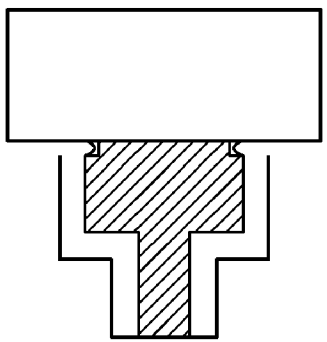

In step S120, upon the lapse of a predetermined time after the start of driving the cap motor 34, the downward moving distance of the cap 32 and cap holder 33 corresponding to the number of revolutions of the cap motor 34 is determined from an output from the cap encoder 35. If the moving distance of the cap 32 and cap holder 33 is smaller than a predetermined value, the process advances to step S130. In this case, the cap 32 and cap holder 33 have not moved apart from the printhead 31, as shown in FIG. 4C. It is determined that the printhead 31 and cap 32 stick to each other. If the moving distance of the cap 32 and cap holder 33 is equal to or larger than the predetermined value, the process advances to step S160. In this case, the printhead 31 and cap 32 do not stick to each other, as shown in FIG. 4B. It is determined that the cap 32 moves apart from the printhead 31 and normally opens.

Figure 4D:
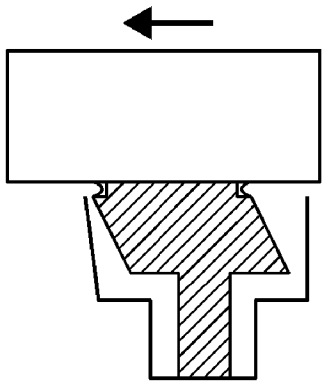
Figure 4E:
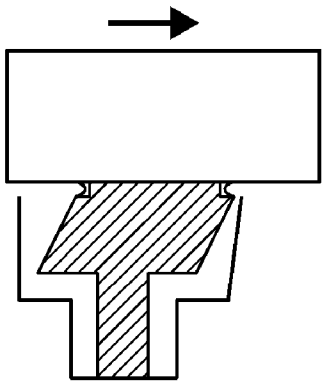

In step S130, while the cap motor 34 remains driven, the carriage motor 13 is slightly driven to slightly move (slightly reciprocate) the carriage 2 in the horizontal direction. At this time, the carriage 2 is driven by the same amount in the right and left directions. The moving distance of the carriage 2 corresponding to the number of revolutions of the carriage motor 13 is detected from an output from the encoder 14. By slightly moving the carriage 2, the positional relationship between the printhead 31 mounted on the carriage 2, the cap 32, and the cap holder 33 change to a state as shown in FIG. 4D when the carriage is driven left, and a state as shown in FIG. 4E when the carriage is driven right. As the carriage 2 is repetitively moved slightly, bubbles enter the joint surface between the printhead 31 and cap 32 in tight contact with each other, forming a gap little by little. Accordingly, the area of the joint surface between the printhead 31 and the cap 32 gradually decreases. Finally, the cap 32 moves apart from the printhead 31, and the cap 32 and cap holder 33 move down by driving the cap motor 34. After the cap 32 moves down, the cap encoder 35 detects in step S140 that the moving distance of the cap 32 becomes equal to or larger than a predetermined value. If it is determined in step S140 that the moving distance of the cap 32 is equal to or larger than the predetermined value, it is determined that the cap has opened normally, as shown in FIG. 4B, and the process advances to step S150. If it is determined in step S140 that the moving distance of the cap 32 is smaller than the predetermined value, it is determined that the printhead 31 and cap 32 still stick to each other, as shown in FIG. 4C. Hence, the carriage 2 keeps moving slightly in the horizontal direction until it is determined that the moving distance of the cap 32 becomes equal to or larger than the predetermined value.

In step S150, the slight movement of the carriage 2 is forcibly stopped immediately because of the following reason. In step S150, the cap has already opened normally. Thus, if the carriage motor 13 is kept driven to slightly move the carriage 2, the carriage 2 is driven in the scanning direction along the chassis 11. If a current amount supplied to the carriage motor 13 to slightly move the carriage 2 is large, the carriage 2 might is driven at high speed along the chassis 11 instantaneously when the cap opens. If the carriage 2 is driven at high speed up to the left or right end of the chassis 11, it bumps into the printing apparatus main body. If a current is kept supplied to the carriage motor 13 even after the carriage 2 bumps against the printing apparatus main body, the carriage 2, chassis 11, and carriage conveyance belt 12 may also be damaged. To prevent this, immediately when it is determined that the cap 32 moves apart from the printhead 31 and opens, supply of a current to the carriage motor 13 is stopped to forcibly stop slightly driving the carriage 2. In this manner, a bump of the carriage 2 against the printing apparatus main body, and damage to the printing apparatus caused by the bump are prevented.

In step S160, the cap motor 34 is kept driven to move the cap 32 to a predetermined position where it can be satisfactorily confirmed that the cap is open. After it is determined that the cap 32 has moved to the predetermined position, the process advances to step S170 to stop driving the cap motor 34.

Figure 5:
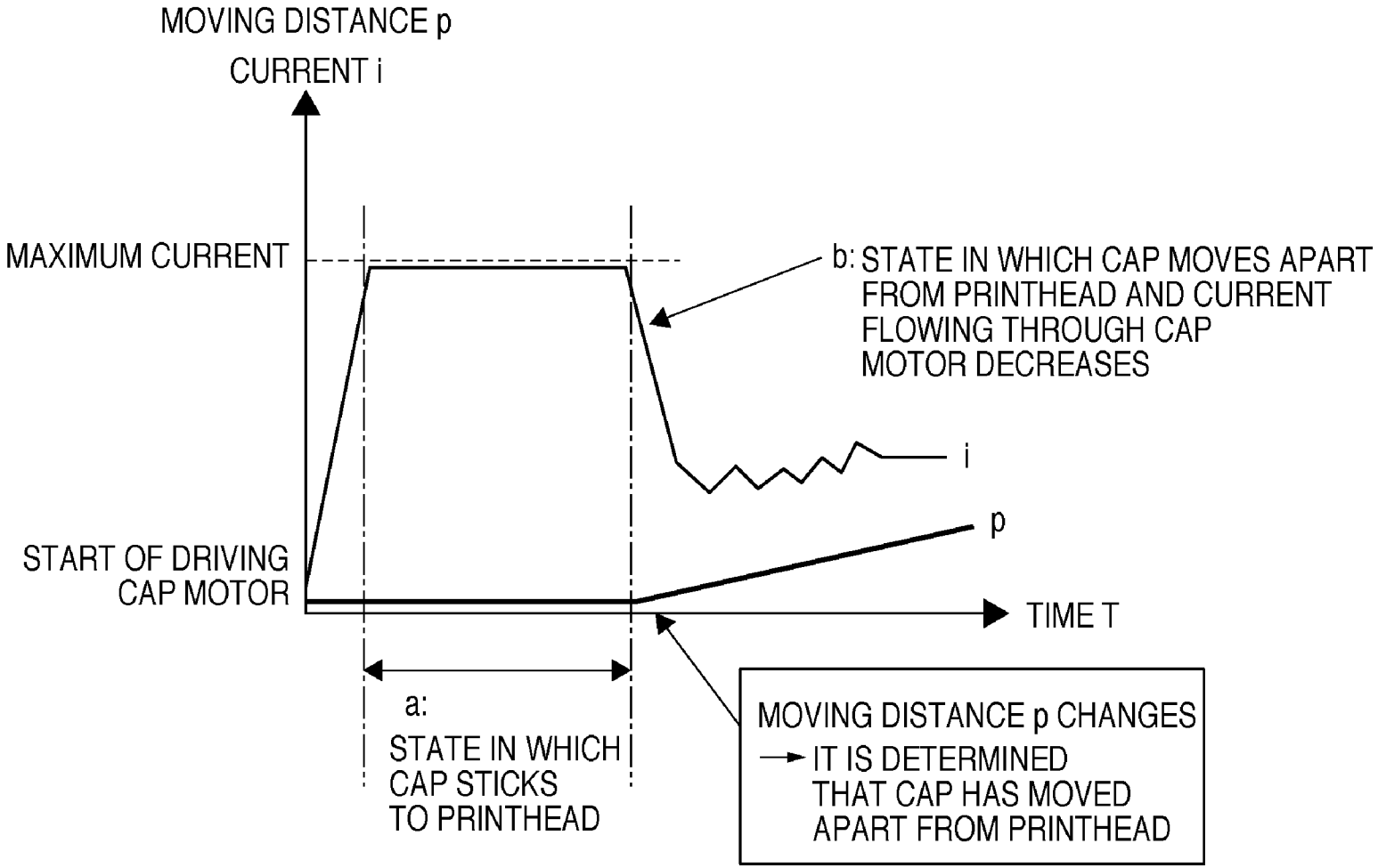
FIG. 5 is a graph showing the moving distance of the cap and a current flowing through the cap motor with respect to the time T elapsed after the start of driving the cap motor when opening the cap.

FIG. 5 is a graph showing a moving distance p and current i with respect to an elapsed time T. In FIG. 5, the abscissa represents the time T elapsed after the start of driving the cap motor 34 when opening the cap, and the ordinate represents the moving distance p of the cap 32 and the current i flowing through the cap motor 34. FIG. 5 shows a case where the cap 32 sticks to the printhead 31.

If the cap 32 does not stick to the printhead 31 and is smoothly opened immediately after the start of driving the cap motor 34, the moving distance p should abruptly increase. However, when the cap 32 sticks to the printhead 31, the cap 32 moves slightly immediately after the start of driving the cap motor 34, but the moving distance p hardly changes while the cap 32 sticks to the printhead 31. In this case, an almost maximum current flows through the cap motor 34 under servo feedback control of the cap motor 34. This state continues while the carriage 2 moves slightly to move the cap 32 apart from the printhead 31 (state a in FIG. 5).

After the cap 32 moves apart from the printhead 31, and the cap encoder 35 confirms that the cap 32 has moved, the current i for driving the cap motor 34 decreases under servo feedback control of the cap motor 34 (state b in FIG. 5). Under this feedback control, the cap motor 34 is driven to move down the cap 32. After the cap 32 moves to a predetermined position, the operation to open the cap ends, and the cap motor 34 stops.

In the operation to open the cap, the moving distance of the cap 32 is confirmed by monitoring an output from the cap encoder 35 a predetermined time after the start of driving the cap motor 34. This predetermined time is desirably determined in consideration of a failure in driving the cap 32 due to a physical or electrical breakdown of the cap motor 34 or a fault of the cap motor 34 itself, the characteristic of the cap motor 34, and the like.

The moving distance of the cap 32 that is detected by the cap encoder 35 for determining whether or not the cap 32 has moved apart from the printhead 31 in the operation to open the cap will be described. Predetermined values for the moving distance in steps S120 and S140 of FIG. 3 are equal to each other. This value is preferably one instantaneously when the cap 32 moves apart from the printhead 31 and changes into the state as shown in FIG. 4B. This value is preferably determined by verification based on an experiment or the like in consideration of the size of the cap holder 33, the characteristic of the cap motor 34, and the like.

A sensor may also detect and determine that the cap 32 has moved apart from the printhead 31, instead of obtaining the moving distance of the cap 32 by the cap encoder 35, comparing it with a predetermined value, and determining that the cap 32 has moved apart from the printhead 31. More specifically, a sensor whose state changes when the cap 32 moves apart from the printhead 31 is arranged around the cap. While driving the cap motor 34, the sensor monitors the cap state to determine that the cap 32 moves apart from the printhead 31. Examples of this sensor are an optical sensor which receives light when the cap opens, and a speed sensor which senses a speed when the cap opens.

Another means for determining that the cap 32 has moved apart from the printhead 31 will be described. When the cap 32 sticks to the printhead 31, a current flowing through the cap motor 34 reaches an almost maximum value, as represented by state a in FIG. 5. As the cap 32 moves apart from the printhead 31, the value of a current flowing through the cap motor 34 decreases, as represented by state b in FIG. 5. For this reason, it is also possible to monitor the value of a current flowing through the cap motor 34, detect that the current value drops to less than a predetermined threshold, and determine that the cap 32 has moved apart from the printhead 31.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-324013, filed Dec. 14, 2007, which is hereby incorporated by reference herein in its entirety.

What is claimed is:

1. A printing apparatus having a carriage which scans a printhead for discharging ink from a nozzle, a cap which caps a nozzle formation surface, and cap moving means for driving the cap to move, the apparatus comprising:

detection means for detecting that the cap has moved apart from the printhead from a state in which the cap caps the printhead;

control means for, when the cap moving means is driven to try to move the cap apart from the printhead and the detection means detects that the cap has not moved apart from the printhead, controlling to move the carriage while driving the cap moving means; and stop means for forcibly stopping moving the carriage when the detection means detects that the cap has moved apart from the printhead under control of the control means.

2. The apparatus according to claim 1, wherein the detection means includes:

measurement means for measuring a moving distance of the cap from a position where the cap caps the printhead; and moving distance detection means for detecting that the moving distance of the cap has reached a predetermined value, wherein when the moving distance detection means detects that the moving distance of the cap has reached the predetermined value, the detection means detects that the cap has moved apart from the printhead.

3. The apparatus according to claim 2, wherein the cap moving means includes a cap motor having an encoder, and the measurement means measures the moving distance of the cap based on a number of revolutions of the cap motor that is measured by the encoder.

4. The apparatus according to claim 1, wherein the cap moving means includes a cap motor, and when a current flowing through the cap motor drops to less than a predetermined threshold, the detection means detects that the cap has moved apart from the printhead.

5. The apparatus according to claim 1, wherein the detection means includes a sensor whose state changes when the cap moves apart from the printhead.

6. A method of controlling a printing apparatus including a carriage which scans a printhead for discharging ink from a nozzle, a cap which caps a nozzle formation surface, and cap moving means for driving the cap to move, the method comprising:

driving the cap moving means to try to move the cap apart from the printhead; detecting that the cap has not moved apart from the printhead, and in response to said detecting, controlling to move the carriage while driving the cap moving means; and forcibly stopping the moving of the carriage if the detection means detects that the cap has moved apart from the printhead.

7. A printing apparatus comprising:

a printhead configured to discharge ink from a nozzle;

a carriage configured to scan the printhead;

a cap configured to cap a nozzle formation surface;

a cap moving unit configured to drive the cap to move;

a detection unit configured to detect that the cap has moved apart from the printhead from a state in which the cap caps the printhead;

a controller configured to, when the cap moving unit is driven to try to move the cap apart from the printhead and the detection unit detects that the cap has not moved apart from the printhead, control to move the carriage while driving the cap moving unit; and a stop unit forcibly stopping moving the carriage when the detection unit detects that the cap has moved apart from the printhead under control of the controller.

* * * * *